US010221639B2

(12) United States Patent
Romer et al.

(10) Patent No.: US 10,221,639 B2
(45) Date of Patent: Mar. 5, 2019

(54) DEVIATED/HORIZONTAL WELL PROPULSION FOR DOWNHOLE DEVICES

(71) Applicants: Michael C. Romer, The Woodlands, TX (US); Randy C. Tolman, Spring, TX (US)

(72) Inventors: Michael C. Romer, The Woodlands, TX (US); Randy C. Tolman, Spring, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 196 days.

(21) Appl. No.: 15/253,155

(22) Filed: Aug. 31, 2016

(65) Prior Publication Data

US 2017/0159384 A1 Jun. 8, 2017

Related U.S. Application Data

(60) Provisional application No. 62/261,896, filed on Dec. 2, 2015.

(51) Int. Cl.

| | |
|---|---|
| ***E21B 23/14*** | (2006.01) |
| ***E21B 23/08*** | (2006.01) |
| ***E21B 23/10*** | (2006.01) |
| ***E21B 43/12*** | (2006.01) |
| ***E21B 4/18*** | (2006.01) |
| ***E21B 41/00*** | (2006.01) |
| ***E21B 4/04*** | (2006.01) |
| *E21B 23/00* | (2006.01) |

(52) U.S. Cl.

CPC ..... *E21B 23/14* (2013.01); *E21B 4/04* (2013.01); *E21B 4/18* (2013.01); *E21B 23/10* (2013.01); *E21B 41/0078* (2013.01); *E21B 43/128* (2013.01); *E21B 2023/008* (2013.01)

(58) Field of Classification Search

CPC ..... E21B 23/00; E21B 23/04; E21B 23/08; E21B 23/14; E21B 2023/008; E21B 23/10

See application file for complete search history.

(56) References Cited

U.S. PATENT DOCUMENTS

| | | | | | |
|---|---|---|---|---|---|
| 2,650,314 | A * | 8/1953 | Hennigh | H02K 5/132 | 175/104 |
| 4,113,236 | A * | 9/1978 | Neinast | E21B 17/003 | 104/138.2 |
| 4,616,719 | A * | 10/1986 | Dismukes | E21B 4/02 | 175/107 |
| 4,676,310 | A * | 6/1987 | Scherbatskoy | E21B 23/10 | 166/113 |
| 5,883,489 | A * | 3/1999 | Konrad | F04D 15/0066 | 318/805 |

(Continued)

*Primary Examiner* — Kenneth L Thompson

(74) *Attorney, Agent, or Firm* — ExxonMobil Upstream Research Company—Law Department

(57) ABSTRACT

The disclosure includes a method of placing a wireline device in a deviated well having a hydrostatic column, the method comprising placing a positioning device in a wellbore of the deviated well, electrically powering the positioning device, moving the wireline device across a deviated region of the wellbore using the positioning device, wherein moving includes creating a driving force using the positioning device, and wherein the driving force is at least one of: a mechanical driving force and a fluid pressure driving force.

17 Claims, 5 Drawing Sheets

(56) References Cited

U.S. PATENT DOCUMENTS

| | | | | |
|---|---|---|---|---|
| 8,915,303 | B2 * | 12/2014 | Chalifoux | E21B 33/068 166/377 |
| 9,175,535 | B2 * | 11/2015 | Gregory | E21B 4/02 |
| 9,476,274 | B2 * | 10/2016 | Edmonstone | E21B 23/10 |
| 9,546,544 | B2 * | 1/2017 | Al-Badran | E21B 47/00 |
| 2015/0101791 | A1 * | 4/2015 | Chalifoux | E21B 33/068 166/65.1 |

* cited by examiner

DEVIATED/HORIZONTAL WELL PROPULSION FOR DOWNHOLE DEVICES

CROSS REFERENCE TO RELATED APPLICATION

This application claims the benefit of U.S. Provisional Application No. 62/261,896 filed Dec. 2, 2015, entitled, "Deviated/Horizontal Well Propulsion for Downhole Devices," the entirety of which is incorporated by reference herein.

FIELD OF THE DISCLOSURE

The present disclosure is directed generally to systems and methods for artificial lift in a wellbore and more specifically to systems and methods that utilize a downhole pump to remove a wellbore liquid from the wellbore.

BACKGROUND OF THE DISCLOSURE

Improved hydrocarbon well drilling technologies enable operators to drill hydrocarbon wells (i) that extend for many thousands of meters within the subterranean formation, (ii) that have vertical depths of hundreds or even thousands of meters, and/or (iii) that have highly deviated wellbores. These improved drilling technologies are routinely utilized to drill long and/or deep hydrocarbon wells that permit production of gaseous hydrocarbons from previously inaccessible subterranean formations. However, efficient removal of wellbore liquids from these hydrocarbon wells may be restricted using traditional artificial lift systems, e.g., pumps.

Pumps may generally be most useful for liquids removal and gas production when they are landed at the deepest total vertical depth (TVD) possible, i.e., when they can lift the maximum hydrostatic head from the reservoir. This may be challenging to accomplish when dealing with some deviated or horizontal wells, with wireline equipment being particularly problematic in some instances. For example, pumps, e.g., micro positive displacement (PD) pumps, may be required to be deployed with off-the-shelf 7/16" wireline cable capable of transmitting ~2,500+ Watts of electricity to the alternating current (AC) or direct current (DC) motor or solid state device powering the unit. Equipment installations utilizing wireline may be limited to <65° deviation because the flexible wireline "stacks-out" in the well and does not permit further deployment. Therefore, a need exists for an approach that enables the wireline-deployed equipment (e.g., pumps) to be landed at "high" deviation for maximized reservoir drawdown and gas production without experiencing stack-outs.

In some cases, the equipment can be pumped down to a deeper location in the well when this occurs. However, this is not always possible. For example, some wells may have a standing valve in place below the pump, e.g., to maintain a full hydrostatic column in the tubing. A full hydrostatic column in the tubing may prevent downwards flow and prohibit pumping down the equipment to a deeper location in the well. Since micro PD and solid-state pumps are increasingly being developed and/or used for use in field applications, this creates a serious problem for wells utilizing a hydrostatic column technique. Therefore, a need exists for an approach that enables deployment of equipment (e.g., pumps) in wells utilizing a full hydrostatic column technique.

SUMMARY

The disclosure includes a method of placing a wireline device in a deviated well having a hydrostatic column, the method comprising placing a positioning device in a wellbore of the deviated well, electrically powering the positioning device, and moving the wireline device across a deviated region of the wellbore using the positioning device, wherein moving includes creating a driving force using the positioning device, and wherein the driving force is at least one of: a mechanical driving force and a fluid pressure driving force.

The disclosure includes an apparatus for positioning a wireline device in a deviated well having a hydrostatic column, comprising an electrical input configured to receive electrical power, a motor coupled to the electrical input, a propulsion mechanism operatively coupled to the motor, wherein the propulsion mechanism comprises at least one of a pump configured to create a positive pressure differential between an intake disposed on an upstream end of the apparatus and a discharge outlet disposed on a downstream end of the apparatus, and a pump configured to force a well fluid through an intake disposed on the apparatus and out of an outlet nozzle disposed on the apparatus, at least one propeller configured to propel the apparatus along the deviated well.

The disclosure includes a deviated well tool placement system, comprising a deviated wellbore, wherein at least a portion of the deviated well is deviated >65°, a wireline, an electrical power supply, a positioning device coupled to the wireline, wherein the positioning device comprises a propulsion mechanism operatively coupled to the electrical power supply, and wherein the propulsion mechanism comprises at least one of a pump configured to create a positive pressure differential between an intake disposed on an upstream end of the apparatus and a discharge outlet disposed on a downstream end of the apparatus, a pump configured to force a well fluid through an intake disposed on the apparatus and out of an outlet nozzle disposed on the apparatus, and at least one propeller configured to propel the apparatus along the deviated well.

DETAILED DESCRIPTION

Figure 1:
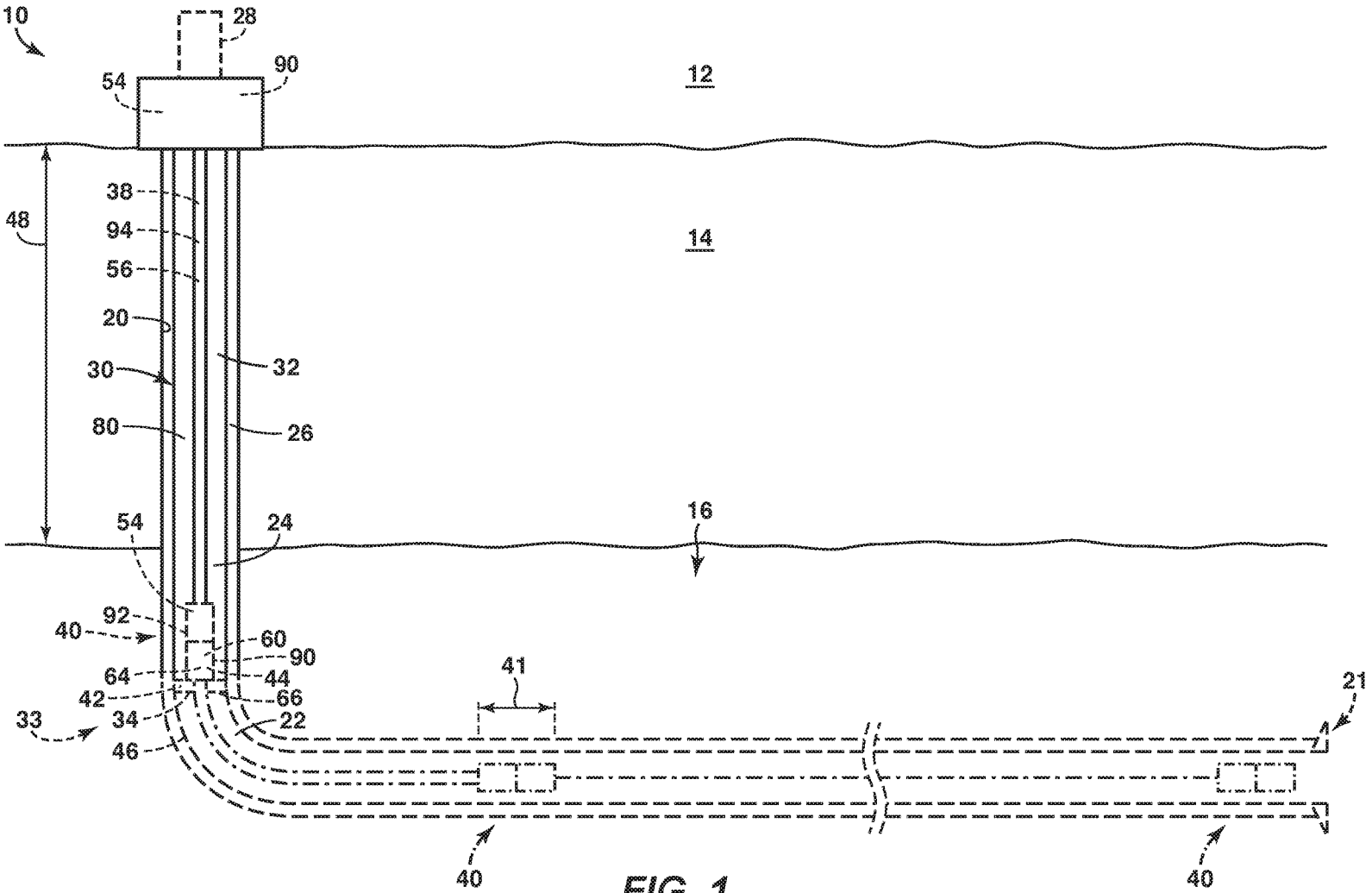
FIG. 1 is a schematic representation of a hydrocarbon well that may be utilized with and/or may include the systems and methods according to the present disclosure.

In the following detailed description section, specific embodiments of the present techniques are described. However, to the extent that the following description is specific to a particular embodiment or a particular use of the present techniques, this is intended to be for exemplary purposes only and simply provides a description of the exemplary embodiments. Accordingly, the techniques are not limited to the specific embodiments described herein, but rather, include all alternatives, modifications, and equivalents falling within the true spirit and scope of the appended claims.

At the outset, for ease of reference, certain terms used in this application and their meanings as used in this context are set forth. To the extent a term used herein is not defined herein, it should be given the broadest definition persons in the pertinent art have given that term as reflected in at least one printed publication or issued patent. Further, the present techniques are not limited by the usage of the terms shown herein, as all equivalents, synonyms, new developments, and terms or techniques that serve the same or a similar purpose are considered to be within the scope of the present claims.

As used herein, the terms "a" and "an," mean one or more when applied to any feature in embodiments of the present inventions described in the specification and claims. The use of "a" and "an" does not limit the meaning to a single feature unless such a limit is specifically stated.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

As used herein, the term "substantial" when used in reference to a quantity or amount of a material, or a specific characteristic thereof, refers to an amount that is sufficient to provide an effect that the material or characteristic was intended to provide. The exact degree of deviation allowable may depend, in some cases, on the specific context.

As used herein, the definite article "the" preceding singular or plural nouns or noun phrases denotes a particular specified feature or particular specified features and may have a singular or plural connotation depending upon the context in which it is used.

While the present techniques may be susceptible to various modifications and alternative forms, the exemplary embodiments discussed herein have been shown only by way of example. However, it should again be understood that the techniques disclosed herein are not intended to be limited to the particular embodiments disclosed. Indeed, the present techniques include all alternatives, modifications, combinations, permutations, and equivalents falling within the true spirit and scope of the appended claims.

Techniques disclosed herein include physically propelling a piece of equipment downhole to a landing location, e.g., by fluid and/or mechanical means. Propulsion techniques envisioned include self-propelled pumps, hydrojets, propellers, and other fluid and/or mechanical propulsion mechanisms. As used herein, the phrase "mechanical driving force" means a force created by one or more mechanical propulsion mechanisms for propelling a wireline-deployed and/or -deployable piece of equipment towards a landing location. As used herein, the phrase "fluid pressure driving force" means a force created by one or more propulsion mechanisms wherein fluid pressure provides a motive force for propelling a wireline-deployed and/or -deployable piece of equipment towards a landing location. By mechanically or fluidly propelling the equipment downhole some problems associated with wireline deployment of equipment into deviated wells (e.g., wells deviated>65°) and/or wells having hydrostatic columns can be overcome. This may increase an overall efficiency of operations that insert downhole equipment into (and/or remove downhole equipment from) a wellbore, may decrease a time required to permit downhole equipment to be inserted into (and/or removed from) the wellbore, and/or may decrease a potential for damage to the hydrocarbon well when downhole equipment is inserted into (and/or removed from) the wellbore. In some embodiments, the disclosed approach only applies to deployment; the equipment may be retrieved simply by pulling the device from the well with its wireline "tether". Some embodiments using the disclosed approach may deploy the device into the well to as high of a deviation as possible using standard wireline deployment methods before the propulsive feature was activated.

In one embodiment, the disclosure includes a self-propelled electric/hydraulic downhole pump having a sealing device separating the pump intake pressure from its discharge pressure that allows the pressure differential to transport an attached device in a well. In another embodiment, the disclosure includes an electric/hydraulic downhole pump with a sealing device that separates the pump intake pressure from its discharge pressure and one or more nozzles that convert a relatively low velocity, high pressure inflow into a relatively high velocity, lower pressure outflow (e.g., using the Venturi effect) and thereby transport an attached device along a deviated well. Alternately or additionally, an electric motor or linear-to-rotational motion converter may drive a dedicated impeller that forces fluid in the tubing through a discharge nozzle, propelling the device to its landing location. In still another embodiment, the disclosure includes an electric motor or electric/hydraulic pump operatively coupled to a propeller/turbine that transports an attached device along a deviated well by pushing it through the wellbore.

Figure 2:
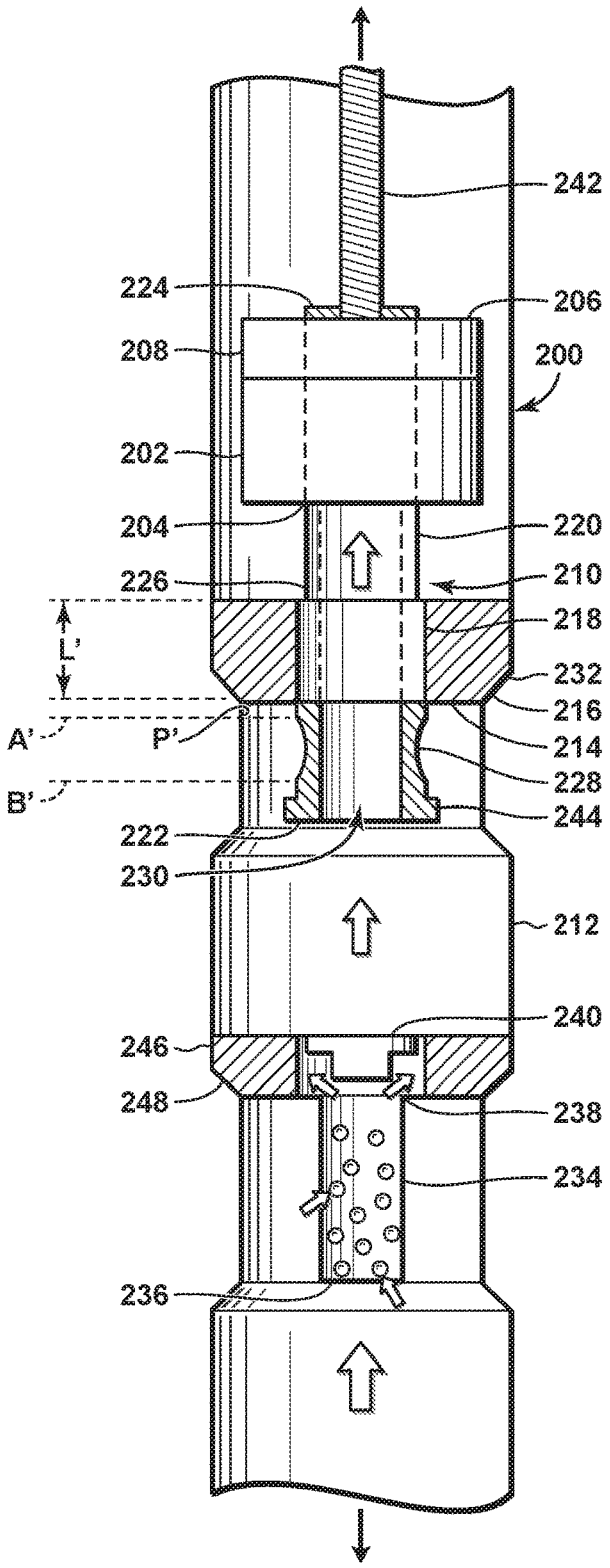
FIG. 2 is a schematic view of a system for removing fluids from a well.

FIG. 1 is a schematic representation of illustrative, non-exclusive examples of a hydrocarbon well 10 that may be utilized with and/or include the systems and methods according to the present disclosure, while FIG. 2 is a schematic block diagram of illustrative, non-exclusive examples of a downhole pump 40 according to the present disclosure that may be utilized with hydrocarbon well 10. Hydrocarbon well 10 includes a wellbore 20 that extends between a surface region 12 and a subterranean formation 16 that is present within a subsurface region 14. The hydrocarbon well further includes a tubing 30 that extends within the wellbore and defines a tubing conduit 32. Downhole pump 40 is located within the tubing conduit at least a threshold vertical distance 48 from surface region 12 (as illustrated in FIG. 1). Threshold vertical distance 48 additionally or alternatively may be referred to herein as threshold vertical depth 48. The downhole pump is configured to receive a wellbore liquid 22 and to pressurize the wellbore liquid to generate a pressurized wellbore liquid 24. A tubing 30 defines a liquid discharge conduit 80 that may extend between downhole pump 40 and surface region 12. The liquid discharge conduit is in fluid communication with tubing conduit 32 via downhole pump 40 and is configured to convey pressurized wellbore liquid 24 from the tubing conduit, such as to surface region 12.

As illustrated in dashed lines in FIG. 1, hydrocarbon well 10 may include a lubricator 28 that may be utilized to locate (i.e., insert and/or position) downhole pump 40 within tubing conduit 32 and/or to remove the downhole pump from the tubing conduit. In addition, and as illustrated in FIG. 1, an injection conduit 38 may extend between surface region 12 and downhole pump 40 and may be configured to inject a corrosion inhibitor and/or a scale inhibitor into tubing conduit 32 and/or into fluid contact with downhole pump 40, such as to decrease a potential for corrosion of and/or scale build-up within the downhole pump.

As also illustrated in dashed lines, hydrocarbon well 10 and/or downhole pump 40 further may include a sand control structure 44, which may be configured to limit flow of sand into an inlet 66 of downhole pump 40, and/or a gas control structure 46, which may limit flow of a wellbore gas 26 (as illustrated in FIG. 1) into inlet 66 (as illustrated in FIG. 2) of downhole pump 40. As further illustrated in dashed lines in FIG. 1, tubing 30 may have a seat 34 attached thereto and/or included therein, with seat 34 being configured to receive downhole pump 40 and/or to retain downhole pump 40 at, or within, a desired region and/or location within tubing 30. Additionally or alternatively, downhole pump 40 may include and/or be operatively attached to a packer 42. Packer 42 may be configured to swell or otherwise be expanded within tubing conduit 32 and to thereby retain downhole pump 40 at, or within, the desired region and/or location within tubing 30.

The hydrocarbon well 10 and/or downhole pump 40 thereof further may include a power source 54 that is configured to provide an electric current to downhole pump 40. In addition, a sensor 92 may be configured to detect a downhole process parameter and may be located within wellbore 20, may be operatively attached to downhole pump 40, and/or may form a portion of the downhole pump. The sensor may be configured to convey a data signal that is indicative of the process parameter to surface region 12 and/or may be in communication with a controller 90 that is configured to control the operation of at least a portion of downhole pump 40.

As also discussed, downhole pump 40 may be powered by (or receive an electric current from) power source 54, which may be operatively attached to the downhole pump, may form a portion of the downhole pump, and/or may be in electrical communication with the downhole pump via an electrical conduit 56. Illustrative, non-exclusive examples of electrical conduit 56 include any suitable wire, cable, wireline, and/or working line, and electrical conduit 56 may connect to downhole pump 40 via any suitable electrical connection and/or wet-mate connection. The electrical conduit 56 may serve as a deployment mechanism, a support mechanism, or both for the downhole pump 40. The power source 54 may itself receive power from various sources, e.g., a generator, an AC generator, a DC generator, a turbine, a solar-powered power source, a wind-powered power source, and/or a hydrocarbon-powered power source that may be located within surface region 12 and/or within wellbore 20. When power source 54 is located within wellbore 20, the power source also may be referred to herein as a downhole power generation assembly 54. In some embodiments, downhole pump 40 may alternately or additionally be configured to use an alternate power source, e.g., a battery pack, within the scope of this disclosure. Embodiments comprising a battery pack may locate the battery pack within surface region 12, may be located within wellbore 20, and/or may be operatively and/or directly attached to downhole pump 40.

Thus, downhole pump 40 according to the present disclosure may be configured to generate pressurized wellbore liquid 24 without utilizing a reciprocating mechanical linkage that extends between surface region 12 and the downhole pump (such as might be utilized with traditional rod pump systems) to provide a motive force for operation of the downhole pump. This may permit downhole pump 40 to be utilized in long, deep, and/or deviated wellbores where traditional rod pump systems may be ineffective, inefficient, and/or unable to generate the pressurized wellbore liquid 24.

The downhole pump may be configured to generate pressurized wellbore liquid 24 (and/or to remove the pressurized wellbore liquid from tubing conduit 32 via liquid discharge conduit 80) without requiring a threshold minimum pressure of wellbore gas 26. This may permit downhole pump 40 to be utilized in hydrocarbon wells 10 that do not develop sufficient gas pressure to permit utilization of traditional plunger lift systems and/or that define long and/or deviated tubing conduits 32 that preclude the efficient operation of traditional plunger lift systems.

The downhole pump 40 may operate as a positive displacement pump and thus may be sized, designed, and/or configured to generate pressurized wellbore liquid 24 at a pressure that is sufficient to permit a volume of the pressurized wellbore liquid to be conveyed via liquid discharge conduit 80 to surface region 12 without utilizing a large number of pumping stages. It follows that reducing the number of pumping stages may decrease a length 41 of the downhole pump (as illustrated in FIG. 1). As illustrative, non-exclusive examples, downhole pump 40 may include fewer than five stages, fewer than four stages, fewer than three stages, or a single stage. The downhole pump 40 may be a rotating pump, e.g., a gerotor pump, an internal gear pump, an external gear pump, a triple screw pump, an axial piston pump, a rotary vane pump, a radial piston pump, a centrifugal pump, etc. Downhole pump 40 may also be a reciprocating pump or a diaphragm/membrane pump.

As additional illustrative, non-exclusive examples, the downhole pump may have a length in a range from X to Y, wherein X is a value selected from 1 meter(s) (m), 2 m, 4 m, 6 m, 8 m, 10 m, 12 m, 14 m, 16 m, 18 m, 20 m, 22 m, 24 m, 26 m, or 28 m, and wherein Y is a value selected from 2 m, 4 m, 6 m, 8 m, 10 m, 12 m, 14 m, 16 m, 18 m, 20 m, 22 m, 24 m, 26 m, 28 m, or 30 m. Additionally or alternatively, the downhole pump may have an outer diameter in a range from X to Y, wherein X is a value selected from 1 cm, 3 cm, 5 cm, 6 cm, 7 cm, 8 cm, 9 cm, 10 cm, 12 cm, 14 cm, 16 cm, or 18 cm, and wherein Y is a value selected from 3 cm, 5 cm, 6 cm, 7 cm, 8 cm, 9 cm, 10 cm, 12 cm, 14 cm, 16 cm, 18 cm, or 20 cm.

This (relatively) small length and/or (relatively) small diameter of downhole pumps 40 according to the present disclosure may permit the downhole pumps to be located within and/or to flow through and/or past deviated regions 33 within wellbore 20 and/or tubing conduit 32. The non-linear region 33 may include and/or be a tortuous region, a curvilinear region, an L-shaped region, an S-shaped region, and/or a transition region between a (substantially) horizontal region and a (substantially) vertical region that may define a tortuous trajectory, a curvilinear trajectory, a deviated trajectory, an L-shaped trajectory, an S-shaped trajectory, and/or a transitional, or changing, trajectory. These deviated regions might obstruct and/or retain longer and/or larger-diameter traditional pumping systems that do not include downhole pump 40 and/or that utilize a larger number (such as more than 5, more than 6, more than 8, more than 10, more than 15, or more than 20) of stages to generate pressurized wellbore liquid 24. Thus, downhole pumps 40 according to the present disclosure may be operable in hydrocarbon wells 10 that are otherwise inaccessible to more traditional artificial lift systems. This may include locating downhole pump 40 uphole from deviated regions 33, as schematically illustrated in dashed lines in FIG. 1, and/or locating downhole pump 40 downhole from deviated regions 33, such as in a horizontal portion of wellbore 20 and/or near a toe end 21 of wellbore 20 (as schematically illustrated in dash-dot lines in FIG. 1).

Additionally or alternatively, the (relatively) small length and/or the (relatively) small diameter of downhole pumps 40 according to the present disclosure may permit the downhole pumps to be located within tubing conduit 32 and/or removed from tubing conduit 32 via lubricator 28. This may permit the downhole pumps to be located within the tubing conduit without depressurizing hydrocarbon well 10, without killing well 10, without first supplying a kill weight fluid to wellbore 20, and/or while containing wellbore fluids within the wellbore. This may increase an overall efficiency of operations that insert downhole pumps into and/or remove downhole pumps from wellbore 20, may decrease a time required to permit downhole pumps 40 to be inserted into and/or removed from wellbore 20, and/or may decrease a potential for damage to hydrocarbon well 10 when downhole pumps 40 are inserted into and/or removed from wellbore 20.

Furthermore, and as discussed in more detail herein, downhole pumps 40 according to the present disclosure may be configured to generate pressurized wellbore liquid 24 at relatively low discharge flow rates and/or at selectively variable discharge flow rates. This may permit downhole pumps 40 to efficiently operate in low production rate hydrocarbon wells and/or in hydrocarbon wells that generate low volumes of wellbore liquid 22, in contrast to more traditional artificial lift systems.

Downhole pump 40 may include at least one membrane element 60 and a flow direction component 64. Membrane element 60 may be configured to selectively and/or repeatedly transition from an expanded state to a contracted state (and vice versa) during operation of the downhole pump 40, e.g., based on the position of the flow direction component 64. In alternate embodiments, transitioning the membrane element 60 from an expanded state to a contracted state (and vice versa) may include changing the operational direction of rotation for the downhole pump 40. The membrane element 60 may serve as a boundary between the wellbore liquid 24 on one side and the downhole pump 40 on the other.

Flow direction component 64 may be configured to direct a membrane expansion fluid, e.g., a substantially debris-free hydraulic fluid, into and out of at least one membrane element 60. Using a substantially debris-free hydraulic fluid may additionally provide lubrication to the pump 40, e.g., by serving as a lubricating bath for the pump 40. Such a configuration may avoid having to use a rotating seal between the electric motor and the hydraulic pump, which seals may reduce the long-term reliability of the pumping unit. Suitable membrane expansion fluids include dielectric fluids that can lubricate the motor and/or pump, dissipate heat, that are shear and/or pressure resistant to breakdown, that reduce or eliminate foaming, that preserve membrane element material, etc. Those of skill in the art will appreciate that alternate fluids may be suitably utilized within the scope of this disclosure.

The expansion of the membrane element 60 may pressurize the wellbore liquid 24. In some embodiments, the membrane element 60 is configured to expand primarily in a direction along the wellbore, while in other embodiments the membrane element 60 is configured to expand primarily in a direction across the diameter of the wellbore. The membrane element 60 may be configured to resist deformation by implosion. The membrane element 60 may be configured to ensure that no pockets of fluid are retained around the zone between the membrane element and its housing. Some embodiments of downhole pump 40 may include a plurality of membrane elements 60. Embodiments including a second membrane element 60 may be configured such that the second membrane element 60 expands during the contract cycle of the first membrane element 60, and wherein the second membrane element 60 contracts during the expand cycle of the first membrane element 60. For example, the flow direction component 64 may direct at least a portion of the membrane expansion fluid from the first membrane element 60 into the second membrane element 60 when the flow direction component 64 is in a first position and direct at least a portion of the membrane expansion fluid from the second membrane element 60 into the first membrane element 60 in a second position. In some embodiments, the flow direction component 64 can switch from the first position to the second position without changing either the speed or direction of the downhole pump 40. In some embodiments, the first membrane element 60 and the second membrane element 60 serve as a boundary between the wellbore liquid 24 on one side and the downhole pump 40 on the other.

As discussed in more detail herein, a discharge flow rate of pressurized wellbore liquid 24 that is generated by downhole pump 40 may be controlled, regulated, and/or varied by controlling, regulating, and/or varying a frequency of an AC electric current that is provided to downhole pump 40. This may include increasing the frequency of the AC electric current to increase the discharge flow rate (by decreasing a time that it takes for the downhole pump to transition between the expanded state and the contracted state) and/or decreasing the frequency of the AC or DC electric current to decrease the discharge flow rate (by increasing the time that it takes for the downhole pump to transition between the expanded state and the contracted state). Some embodiments may alternately or additionally utilize a variable speed drive (VSD) to vary the operational speed of the downhole pump 40.

Controller 90 may include any suitable structure that may be configured to control the operation of any suitable portion of hydrocarbon well 10, such as downhole pump 40 and/or flow direction component 64. The controller 90 may be located in any suitable portion of hydrocarbon well 10. The controller 90 may include and/or be an autonomous and/or automatic controller and may be located in a suitable location, e.g., within wellbore 20, outside of wellbore 20 and operatively attached to downhole pump 40, etc. In some embodiments, the controller 90 may be configured to control the operation of downhole pump 40 without requiring that a data signal be conveyed to surface region 12 via data communication conduit 94. In some embodiments, the controller 90 may be located within surface region 12 and may be configured to communicate with downhole pump 40 via data communication conduit 94.

The controller 90 may be programmed to maintain a target wellbore liquid level within wellbore 20 above downhole pump 40. This may include increasing a discharge flow rate of pressurized wellbore liquid 24 that is generated by the downhole pump to decrease the wellbore liquid level and/or decreasing the discharge flow rate to increase the wellbore liquid level.

The controller 90 may be programmed to regulate the discharge flow rate to control the discharge pressure from the downhole pump 40 and/or to control the volumetric throughput from the downhole pump 40. This may include increasing the discharge flow rate to increase the discharge pressure or volumetric throughput, and/or decreasing the discharge flow rate to decrease the discharge pressure or volumetric throughput, as appropriate.

A sensor 92 may be coupled to the downhole pump 40. The sensor 92 may include any suitable structure that is configured to detect the downhole parameter, e.g., a downhole temperature, a downhole pressure, component/system vibration, a discharge pressure from the downhole pump, a downhole flow rate, a volumetric throughput of the downhole pump, and/or a discharge flow rate from the downhole pump. The sensor 92 may be configured to detect the downhole parameter at any suitable location within wellbore 20. As an illustrative, non-exclusive example, the sensor may be located such that the downhole parameter is indicative of a condition at an inlet to downhole pump 40. The sensor 92 may be located such that the downhole parameter is indicative of a condition at an outlet from downhole pump 40.

When hydrocarbon well 10 includes sensor 92, the hydrocarbon well 10 may include a data communication conduit 94 configured to convey a signal indicative of the downhole parameter between sensor 92 and surface region 12. The data communication conduit 94 may convey the signal to the controller 90 when the controller 90 is located within surface region 12. The data communication conduit 94 may alternately or additionally convey the signal to a display and/or to a terminal located at surface region 12.

As discussed, downhole pump 40 according to the present disclosure may be utilized to provide artificial lift in wellbores that define a large vertical distance, or depth, 48, in wellbores that define a large overall length, and/or in wellbores in which downhole pump 40 is located at least a threshold vertical distance from surface region 12. For example, the vertical depth of wellbore 20, the overall length of wellbore 20, and/or the threshold vertical distance of downhole pump 40 from surface region 12 may be a value in a range from X to Y, wherein X is selected from 250 m, 500 m, 750 m, 1000 m, 1250 m, 1500 m, 1750 m, 2000 m, 2250 m, 2500 m, 2750 m, 3000 m, and 3250 m, and wherein Y is selected from 500 m, 750 m, 1000 m, 1250 m, 1500 m, 1750 m, 2000 m, 2250 m, 2500 m, 2750 m, 3000 m, and 3250 m, and 3500 m. Additionally or alternatively, the vertical depth of wellbore 20, the overall length of wellbore 20, and/or the threshold vertical distance of downhole pump 40 from surface region 12 may be a value in a range between X and Y, wherein X is selected from 8000 m, 7750 m, 7500 m, 7250 m, 7000 m, 6750 m, 6500 m, 6250 m, 6000 m, 5750 m, 5500 m, 5250 m, 5000 m, 4750 m, 4500 m, and 4250 m, and wherein Y is selected from 7750 m, 7500 m, 7250 m, 7000 m, 6750 m, 6500 m, 6250 m, 6000 m, 5750 m, 5500 m, 5250 m, 5000 m, 4750 m, 4500 m, 4250 m, 4000 m. Further additionally or alternatively, the vertical depth of wellbore 20, the overall length of wellbore 20, and/or the threshold vertical distance of downhole pump 40 from surface region 12 may be in a range defined, or bounded, by any combination of the preceding maximum and minimum depths.

FIG. 2 is a schematic view of a system for 200 removing fluids from a well, according to the present disclosure is presented. The components of FIG. 2 may be substantially the same as the corresponding components of the prior figures except as otherwise noted. The system 200 includes a pump 202, e.g., the downhole pump 40 of FIG. 1, having an inlet end 204 and a discharge end 206. A motor 208 is operatively connected to the pump 202 for driving the pump 202.

The system 200 includes an apparatus 210 for reducing the force required to pull the pump 202 from a tubular 212. As shown, the apparatus 210 may be positioned upstream of the pump 202. Apparatus 210 includes a tubular sealing device 214 for mating with a downhole tubular component 216, the tubular sealing device 214 having an axial length L' and a longitudinal bore 218 therethrough.

Apparatus 210 also includes an elongated rod 220, slidably positionable within the longitudinal bore 218 of the tubular sealing device 214. The elongated rod 220 includes a first end 222, a second end 224, and an outer surface 226. As shown in FIG. 2, the outer surface 226 is configured to provide a hydraulic seal when the elongated rod is in a first position (when position A' is aligned with point P') within the longitudinal bore 218 of the tubular sealing device 214. Also, as shown in FIG. 2, the outer surface 226 of elongated rod 220 is configured to provide at least one external flow port 228 for pressure equalization upstream and downstream of the tubular sealing device 214 when the elongated rod 220 is placed in a second position (when position B' is aligned with point P') within the longitudinal bore 218 of the tubular sealing device 214. The elongated rod 220 may include an axial flow passage 230 extending therethrough, the axial flow passage in fluid communication with the pump 202.

The tubular sealing device 214 may be configured for landing within a nipple profile (not shown) or for attaching to a collar stop 232 for landing directly within the tubular 212. In some embodiments, a well screen or filter 234 is provided, the well screen or filter 234 in fluid communication with the inlet end 204 of the pump 202, the well screen or filter 234 having an inlet end 236 and an outlet end 238.

A velocity fuse or standing valve 240 may be positioned between the outlet end 238 of the well screen or filter 234 and the first end 222 of the elongated rod 220. As shown, the velocity fuse 240 is in fluid communication with the well screen or filter 234. In some embodiments, the velocity fuse 240 is configured to back-flush the well screen or filter 234 and maintain a column of fluid within the tubular 212 in response to an increase in pressure drop across the velocity fuse 240. In some embodiments, the velocity fuse 240 is normally open and comprises a spring-loaded piston responsive to changes in pressure drop across the velocity fuse 240.

The apparatus 210 is configured to be installed and retrieved from the tubular 212 by a wireline or coiled tubing 242. In some embodiments, the apparatus 210 is integral to the tubing string. In some embodiments, the first end 222 of the elongated rod 220 includes an extension 244 for applying a jarring force to the tubular sealing device 214 to assist in the removal thereof.

The velocity fuse 240 may be installed within a housing 246. In some embodiments, the housing 246 is configured for sealingly engaging the tubular 212. In some embodiments, the housing 246 comprises at least one seal 248. In some embodiments, the housing 246 may be configured to seat within a tubular 212, as shown.

Figure 3:
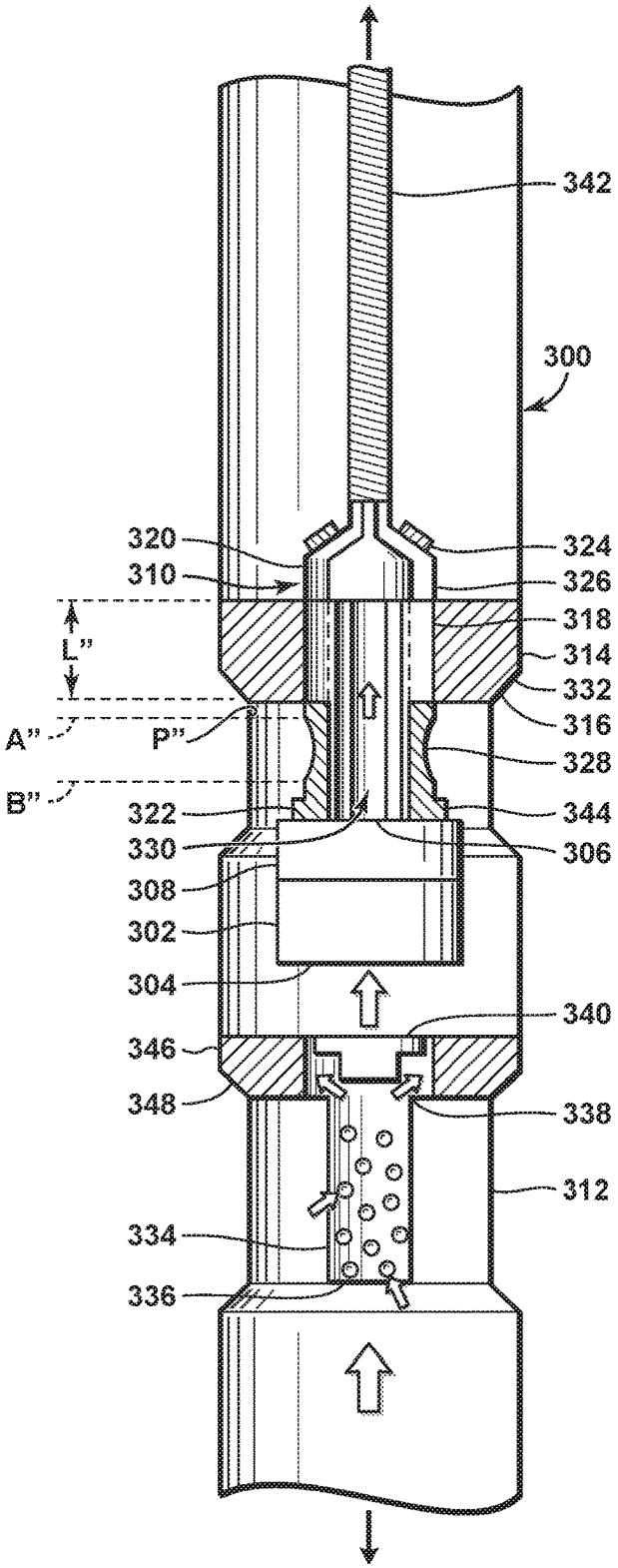
FIG. 3 is a schematic view of a system for removing fluids from a well.

FIG. 3 is a schematic view of a system 300 for removing fluids from a well, according to the present disclosure. The components of FIG. 3 may be substantially the same as the corresponding components of the prior figures except as otherwise noted. The system 300 includes a pump 302, e.g., the downhole pump 40 of FIG. 1, having an inlet end 304 and a discharge end 306. A motor 308 is operatively connected to the pump 302 for driving the pump 302.

The system 300 also includes an apparatus 310 for reducing the force required to pull the pump 302 from a tubular 312. As shown, the apparatus 310 may be positioned downstream of the pump 302. Apparatus 310 includes a tubular sealing device 314 for mating with a downhole tubular component 316, the tubular sealing device 314 having an axial length L" and an longitudinal bore 318 therethrough.

Apparatus 310 also includes an elongated rod 320, slidably positionable within the longitudinal bore 318 of the tubular sealing device 314. The elongated rod 320 includes a first end 322, a second end 324, and an outer surface 326. As shown in FIG. 3, the outer surface 326 is configured to provide a hydraulic seal when the elongated rod is in a first position (when position A" is aligned with point P") within the longitudinal bore 318 of the tubular sealing device 314. Also, as shown in FIG. 3, the outer surface 326 of elongated rod 320 is configured to provide at least one external flow port 328 for pressure equalization upstream and downstream of the tubular sealing device 314 when the elongated rod 320 is placed in a second position (when position B" is aligned with point P") within the longitudinal bore 318 of the tubular sealing device 314. In some embodiments, the elongated rod 320 includes an axial flow passage 330 extending therethrough, the axial flow passage in fluid communication with the pump 302. In some embodiments, the tubular sealing device 314 is configured for landing within a nipple profile (not shown) or for attaching to a collar stop 332 for landing directly within the tubular 312. In some embodiments, a well screen or filter 334 is provided, the well screen or filter 334 in fluid communication with the inlet end 304 of the pump 302, the well screen or filter 334 having an inlet end 336 and an outlet end 338.

In some embodiments, a velocity fuse or standing valve 340 is positioned between the outlet end 338 of the well screen or filter 334 and the first end 322 of the elongated rod 320. As shown, the velocity fuse 340 is in fluid communication with the well screen or filter 334. In some embodiments, the velocity fuse 340 is configured to back-flush the well screen or filter 334 and maintain a column of fluid within the tubular 312 in response to an increase in pressure drop across the velocity fuse 340. As will be described below, the velocity fuse 340 is normally open and comprises a spring-loaded piston responsive to changes in pressure drop across the velocity fuse 340.

The apparatus 310 may be configured to be installed and retrieved from the tubular 312 by a wireline or coiled tubing 342. In some embodiments, the apparatus 310 is integral to the tubing string. In some embodiments, the first end 322 of the elongated rod 320 includes an extension 344 for applying a jarring force to the tubular sealing device 314 to assist in the removal thereof. In some embodiments, the velocity fuse 340 may be installed within a housing 346. In some embodiments, the housing 346 is configured for sealingly engaging the tubular 312. The housing 346 may comprise at least one seal 348. The housing 346 may be configured to seat within a tubular 312.

Figure 4:
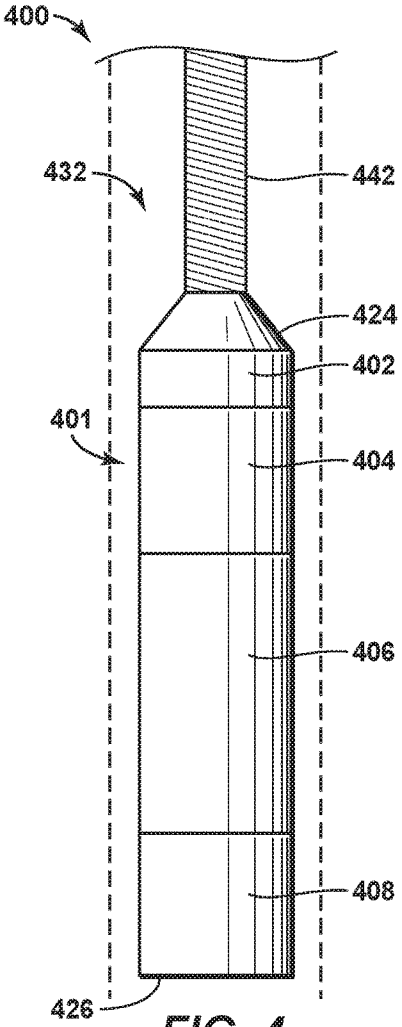
FIG. 4 is a simplified schematic view of a system for removing fluids from a well.

FIG. 4 is a simplified schematic view of a system for 400 removing fluids from a deviated well, e.g., a wellbore 20 of FIG. 1. For example, the well may be deviated >65°, defines a tortuous trajectory, a curvilinear trajectory, a deviated trajectory, an L-shaped trajectory, an S-shaped trajectory, and/or a transitional, or changing, trajectory, etc., according to the present disclosure. The disclosed techniques may be suitably employed with wells comprising one or more deviations >65°, >70°, >75°, >80°, >85°, and >90°. The components of FIG. 4 may be substantially the same as the corresponding components of the prior figures except as otherwise noted. The system 400 includes a positioning device 401 in a tubing conduit 432, e.g., the tubing conduit 32 of FIG. 1. The positioning device 401 is coupled on a first end 424, e.g., a downstream end, to coiled tubing or wireline 442, e.g., an electrical conduit 56 of FIG. 1, at an electrical connector component 402. In some embodiments, the wireline 442 is configured to supply electrical power, e.g., from a power source 54 of FIG. 1, to the positioning device 401 at an electrical connector component 402. In some embodiments, positioning device 401 may alternately or additionally be configured to use an alternate power source, e.g., a battery pack, to supply electrical power to the positioning device 401 within the scope of this disclosure. Embodiments comprising a battery pack may locate the battery pack such that the battery pack is operatively and/or directly attached to positioning device 401, e.g., at the electrical connector component 402. The electrical connector component 402 is coupled to a propulsion component 404. As will be discussed further herein, the propulsion component 404 may be a component suitably designed to move the positioning device 401 downhole by creating a driving force, e.g., a mechanical driving force, a fluid pressure driving force, or a combination thereof. The propulsion component 404 is coupled to a downhole device 406, e.g., an apparatus 310 of FIG. 3. Those of skill in the art will appreciate that the propulsion component 404 may be suitably coupled to the downhole device 406 in a variety of ways and this disclosure is not limited to any particular coupling mechanism. The propulsion device 401 further comprises an electric motor 408, e.g., an electric motor 308 of FIG. 3. The electric motor 408 may be operatively coupled to the downhole device 406, the propulsion component 404, or both, and may be configured to receive electrical power from the electrical connector component 402. The positioning device 401 further comprises a second end 426, e.g., an upstream end.

Figure 5B:
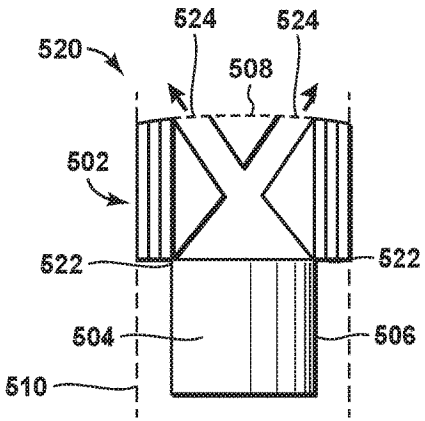
FIG. 5B is a simplified schematic of a second embodiment of a propulsion component according to the present disclosure.
Figure 5A:
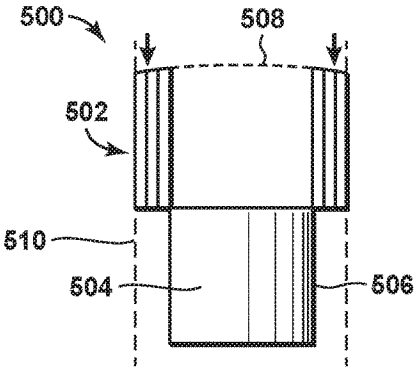
FIG. 5A is a simplified schematic of a first embodiment of a propulsion component according to the present disclosure.

FIG. 5A is a simplified schematic of a first embodiment of a propulsion component 500, e.g., a propulsion component 404 of FIG. 4. The propulsion component 500 has a sealing assembly 502 disposed on an outer surface of the propulsion component 500 and a pump 504 having a pump intake 506 on an upstream side of the sealing assembly 502 and a pump discharge 508 on a downstream side of the sealing assembly 502. The propulsion component 500 comprises a sealing assembly 502, e.g., a plurality of swab cups, disposed on an outer surface of the propulsion component 500 and configured to sealably engage the production tubing 510, e.g., a tubing 30 of FIG. 1. By sealably engaging the production tubing 510, the sealing assembly 502 separates an upstream pressure on an upstream side of the sealing assembly 500 from a downstream pressure on a downstream side of the sealing assembly 500. In some embodiments, the seal between the sealing assembly 502 and the production tubing 510 will be a "loose" sealing assembly, meaning that it may permit a suitable amount of leak-by and/or bypass in order to create a slipping seal between the sealing assembly 502 and the production tubing 510. The propulsion component 500 is configured such that the pump 504 will create a relatively lower suction pressure on an upstream side of the sealing assembly 500 for the fluid at the pump intake 506 and a relatively higher discharge pressure for the fluid pump discharge 508 on a downstream side of the sealing assembly 500. The differential pressure across the propulsion component 500 may be used to transport the propulsion component 500 and, consequently, a downhole device, e.g., a downhole device 406 of FIG. 4, along a deviated well.

As previously described, the propulsion component 500 may be beneficially operated when a standing valve (not depicted) is in place to maintain a full hydrostatic column in the tubing. Since the downhole standing valve may keep the tubing full of fluid, the propulsion component 500 may displace fluid from the pump intake 506 to the pump discharge 508. This may create a positive pressure differential between the discharge and the intake. The positive pressure differential between the discharge and intake (e.g., across the swab cups) may be used to transport and/or propel the propulsion component 500 downhole to a desired vertical depth, e.g., vertical depth 48 of FIG. 1.

In some embodiments, the propulsion component 500 is in communication with a controller, e.g., the controller 90 of FIG. 1, and/or one or more sensors, e.g., sensor 92 of FIG. 1. These embodiments may be configured to change the speed of the pump 504 when a predetermined condition is sensed. These conditions may include increasing speed, reducing speed, or securing the pump 504 when pressure passes a predetermined level at the pump intake 506, at the pump discharge 508, when differential pressure between the pump intake 506 and the pump discharge 508 passes a predetermined level, when a predetermined depth is detected, or any combination thereof.

FIG. 5B is a simplified schematic of a second embodiment of a propulsion component 520, e.g., a propulsion component 404 of FIG. 4. The components of FIG. 5B may be substantially the same as the corresponding components of the prior figures except as otherwise noted. The propulsion component 520 has a sealing assembly 502 disposed on an outer surface to engage a production tubing 510 and a pump 504 having a pump intake 506 on an upstream side of the sealing assembly 502 and a pump discharge 508 on a downstream side of the sealing assembly 502. In alternate embodiments, the pump intake 506 may be located on the downstream side of the sealing assembly 502. The propulsion component 520 is configured with one or more high pressure flow inlets 522 configured to receive downhole fluid. The high pressure flow inlets 522 may pass fluid through the body of the propulsion component 520 to one or more discharge nozzles 524. The interaction of the high pressure flow inlets 522 and the discharge nozzles 524 through the propulsion component 520 may be such that it creates a Venturi effect and may result in a hydrojet propulsion mechanism that propels the propulsion component 520 using a fluid pressure driving force. Those of skill in the art will appreciate that the sealing assembly 502 of the embodiment of FIG. 5B may be suitably employed without the "loose" sealing assembly described with respect to FIG. 5B, and such alternate embodiments are considered within the scope of this disclosure.

In some embodiments, the propulsion component 520 is in communication with a controller, e.g., the controller 90 of FIG. 1, and/or one or more sensors, e.g., sensor 92 of FIG. 1. These embodiments may be configured to change the speed of the pump 504 when a predetermined condition is sensed. These conditions may include increasing speed, reducing speed, or securing the pump 504 when pressure passes a predetermined level at the pump intake 506, at the pump discharge 508, when differential pressure between the pump intake 506 and the pump discharge 508 passes a predetermined level, when a predetermined depth is detected, or any combination thereof.

Figure 5C:
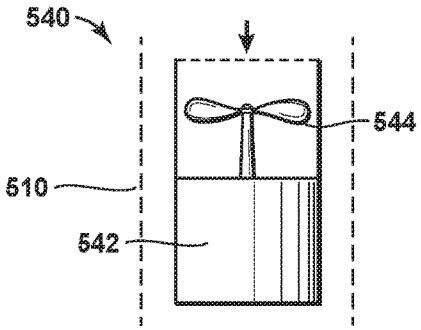
FIG. 5C is a simplified schematic of a third embodiment of a propulsion component according to the present disclosure.

FIG. 5C is a simplified schematic of a third embodiment of a propulsion component 540, e.g., a propulsion component 404 of FIG. 4. The components of FIG. 5B may be substantially the same as the corresponding components of the prior figures except as otherwise noted. The propulsion component 540 comprises a motor 542, e.g., an electric motor or linear-to-rotational motion converter, operatively coupled to at least one propeller 544. Some embodiments may include a housing, a cage, a guard, or another suitable structure for protecting the blades of the propeller 544. Some embodiments may include a plurality of propellers 544 operatively coupled to the motor 542 to obtain the desired propulsion characteristics. Some embodiments may include a sealing assembly, e.g., a sealing assembly 502 of FIG. 5B, disposed on an outer surface of the propulsion component 540 and configured to engage the production tubing 510. In operation, actuation of the propeller 544 may create a mechanism of propulsion that employs a fluid pressure driving force on a downstream side of the propulsion component 540.

In some embodiments, the propulsion component 540 is in communication with a controller, e.g., the controller 90 of FIG. 1, and/or one or more sensors, e.g., sensor 92 of FIG. 1. These embodiments may be configured to change the speed of the motor 542 when a predetermined condition is sensed. These conditions may include increasing speed, reducing speed, or securing the motor 542 when propeller cavitation is sensed, when propeller damage is sensed, when particulate levels exceed a threshold amount, when there is excessive entrained gas or insufficient fluid for desired propeller operation, when a predetermined depth is detected, or any combination thereof.

Those of skill in the art will appreciate that the embodiments depicted in FIGS. 5A-5C may be used in combination in some embodiments, and such embodiments are considered within the scope of this disclosure.

Figure 6:
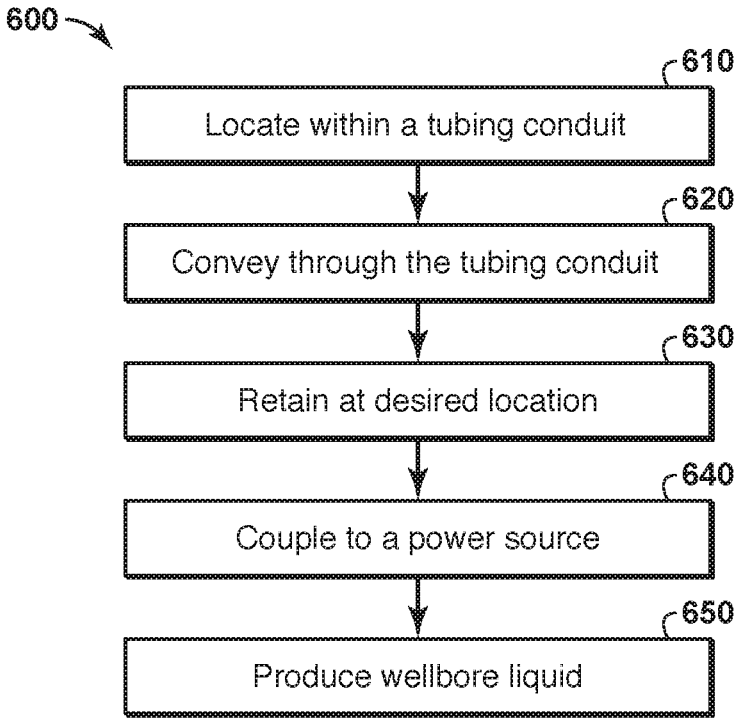
FIG. 6 is a flowchart depicting a method according to the present disclosure of locating a downhole pump.

FIG. 6 is a flowchart depicting a method 600 according to the present disclosure of locating a downhole pump, e.g., the downhole pump 40 of FIG. 1, within a wellbore, e.g., the wellbore 20 of FIG. 1, that extends within a subterranean formation, e.g., the subterranean formation 16 of FIG. 1. The method 600 includes locating the downhole pump within a tubing conduit at 610 and conveying the downhole pump through the tubing conduit at 620. The method 600 may include retaining the downhole pump at a desired location within the tubing conduit at 630, coupling the downhole pump with a power source at 640, and/or producing a wellbore liquid from the wellbore at 650.

Locating the downhole pump within the tubing conduit at 610 may include locating the downhole pump in any suitable tubing conduit that may be defined by a tubing that extends within the wellbore. As an illustrative, non-exclusive example, the locating at 610 may include placing the downhole pump within a lubricator that is in selective fluid communication with the tubing conduit and/or transferring the downhole pump from the lubricator to the tubing conduit. As another illustrative, non-exclusive example, the locating at 610 also may include locating without first killing a hydrocarbon well that includes the wellbore, locating without supplying a kill weight fluid to the wellbore, locating while containing (all) wellbore fluids within the wellbore, and/or locating without depressurizing (or completely depressurizing) the wellbore (or at least a portion of the wellbore that is proximal to the surface region).

Conveying the downhole pump through the tubing conduit at 620 may include conveying until the downhole pump is at least a threshold vertical distance from the surface region. Illustrative, non-exclusive examples of the threshold vertical distance are disclosed herein.

It is within the scope of the present disclosure that the tubing conduit may define a nonlinear trajectory and/or a nonlinear region, e.g., as described in FIG. 1, and that the conveying at 620 may include conveying along the nonlinear trajectory, through the nonlinear region, and/or past the nonlinear region. Illustrative, non-exclusive examples of the nonlinear region and/or the nonlinear trajectory are discussed herein.

The conveying may be accomplished in any suitable manner. As an illustrative, non-exclusive example, the conveying may include establishing a fluid flow from the surface region, through the tubing conduit, and into the subterranean formation; and the conveying at 620 may include flowing the downhole pump through the tubing conduit with the fluid flow. As additional illustrative, non-exclusive examples, the conveying at 620 also may include conveying on a wireline, conveying with coiled tubing, conveying with rods, and/or conveying with a tractor.

Retaining the downhole pump at the desired location within the tubing conduit at 630 may include retaining the downhole pump in any suitable manner. As an illustrative, non-exclusive example, the retaining at 630 may include swelling a packer that is operatively attached to the downhole pump to retain the downhole pump at the desired location. As another illustrative, non-exclusive example, the retaining at 630 also may include locating the downhole pump on a seat that is present within the tubing conduit and that is configured to receive and/or to retain the downhole pump.

Coupling the downhole pump with the power source at 640 may include coupling the downhole pump with the power source subsequent to the conveying at 620. Illustrative, non-exclusive examples of the power source are disclosed herein.

Producing the wellbore liquid from the wellbore at 650 may include producing the wellbore liquid with the downhole pump and may be accomplished in any suitable manner. As an illustrative, non-exclusive example, the producing at 650 may be at least substantially similar to the pumping at 630, which is discussed in more detail herein.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently. It is also within the scope of the present disclosure that the blocks, or steps, may be implemented as logic, which also may be described as implementing the blocks, or steps, as logics. In some applications, the blocks, or steps, may represent expressions and/or actions to be performed by functionally equivalent circuits or other logic devices. The illustrated blocks may, but are not required to, represent executable instructions that cause a computer, processor, and/or other logic device to respond, to perform an action, to change states, to generate an output or display, and/or to make decisions.

What is claimed is:

1. A method of placing a wireline device in a deviated well having a hydrostatic column, the method comprising:

placing a positioning device in a wellbore of the deviated well, wherein the positioning device is operatively coupled to position the wireline device and the positioning device and the wireline device are moveable along a length of the wellbore;

electrically powering the moveable positioning device to create a pressure differential driving force across the moveable positioning device sufficient to move the positioning device and the wireline device along the length of the wellbore; and moving the wireline device across a deviated region of the length of the wellbore using the differential pressure driving force created by the positioning device, wherein the differential pressure driving force is a fluid pressure driving force;

creating the differential pressure driving force across the positioning device by effecting an upstream pressure on an upstream side of the positioning device is lower than a downstream pressure on a downstream side of the positioning device; and stopping movement of the wireline device at a predetermined landing location.

2. The method of claim 1, further comprising:

retrieving the wireline device, the positioning device, or both using a wireline tether.

3. The method of claim 1, wherein at least a portion of the deviated well is deviated >65°.

4. The method of claim 1, wherein the driving force is a fluid pressure driving force, further comprising:

creating a propelling force at a downstream side of the positioning device; and stopping movement of the wireline device at a predetermined landing location.

5. The method of claim 1, wherein electrically powering the positioning device comprises supplying DC power to the positioning device.

6. The method of claim 1, further comprising:

controlling the speed of movement of the positioning device, wherein controlling comprises regulating a frequency of an AC electric current that electrically powers the positioning device.

7. An apparatus for positioning a wireline device in a deviated well having a hydrostatic column, comprising:

an electrical input configured to receive electrical power;

an electric motor coupled to the electrical input;

a propulsion mechanism operatively coupled to the electric motor, wherein the propulsion mechanism is configured to propel the wireline device and the propulsion mechanism along a length of the deviated well while the electric motor receives electrical power, the propulsion mechanism comprising at least one of:

a pump configured to create by positive displacement a positive pressure differential between an intake disposed on an upstream end of the apparatus and a discharge outlet disposed on a downstream end of the apparatus;

a hydrojet pump configured to force a well fluid through an intake disposed on the apparatus and out of an outlet nozzle disposed on the apparatus;

at least one propeller configured to propel the apparatus along the deviated well; and at least one sealing device disposed on the apparatus, wherein the sealing device separates a pump intake pressure from a pump discharge pressure.

8. The apparatus of claim 7, wherein the propulsion mechanism comprises a pump, further comprising:

at least one outlet nozzle configured to convert a relatively lower velocity, relatively higher pressure pump discharge stream into a relatively higher velocity, relatively lower pressure apparatus propulsion stream.

9. The apparatus of claim 7, wherein the propulsion mechanism comprises a plurality of propellers configured to propel the apparatus along the deviated well.

10. The apparatus of claim 7, wherein the apparatus further comprises:

a landing surface disposed on an exterior portion of the apparatus, wherein the landing surface is configured to engage a landing location in the deviated well.

11. The apparatus of claim 7, wherein the propulsion mechanism is configured for one-way propulsion operation.

12. The apparatus of claim 11, wherein the apparatus further comprises:

a mounting location for a wireline tether.

13. A deviated well tool placement system, comprising:

a deviated well, wherein at least a portion of the deviated well is deviated >65°;

a wireline;

an electrical power supply;

a positioning device coupled to the wireline, wherein the positioning device comprises an electric motor operatively coupled to the electrical supply for powering a propulsion apparatus, and wherein the propulsion apparatus comprises at least one of:

a pump configured to create by positive displacement a positive pressure differential between an intake disposed on an upstream end of the propulsion apparatus and a discharge outlet disposed on a downstream end of the propulsion apparatus;

a hydrojet pump configured to force a well fluid through an intake disposed on the propulsion apparatus and out of an outlet nozzle disposed on the propulsion apparatus; and at least one propeller configured to propel the propulsion apparatus along the deviated well; and at least one sealing device disposed on an outer surface of the propulsion mechanism apparatus;

wherein the propulsion apparatus is configured to propel a wireline device and the propulsion apparatus along a length of the wellbore while the electric motor receives electrical power.

14. The system of claim 13, wherein the deviated well comprises landing location configured to receive the positioning device, and wherein the landing location is upstream of the portion of the well that is deviated >65°.

15. The system of claim 13, wherein the propulsion apparatus comprises a pump, further comprising:

at least one outlet nozzle configured to convert a relatively lower velocity, relatively higher pressure pump discharge stream into a relatively higher velocity, relatively lower pressure apparatus propulsion stream.

16. The system of claim 13, wherein at least a portion of the deviated well is deviated >85°.

17. The system of claim 13, wherein the electrical power supply is configured to supply an AC electric current, and wherein the system comprises a controller configured to regulate a frequency of the AC electric current.

* * * * *